US006589317B2

(12) United States Patent
Zhang et al.

(10) Patent No.: US 6,589,317 B2
(45) Date of Patent: Jul. 8, 2003

(54) STRUCTURED SURFACE FILTRATION MEDIA ARRAY

(75) Inventors: Zhiqun Zhang, Roseville, MN (US); Tien T. Wu, Woodbury, MN (US); Yuan-Ming Tang, Vadnais Heights, MN (US); Brian E. Spiewak, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/927,976

(22) Filed: Aug. 10, 2001

(65) Prior Publication Data

US 2003/0089236 A1 May 15, 2003

(51) Int. Cl.[7] ..... B03C 3/36

(52) U.S. Cl. ..... 96/62; 55/DIG. 39; 96/66; 96/67; 96/222; 96/69; 96/226

(58) Field of Search ..... 96/15, 69, 66, 96/59, 67, 17, 62, 222, 226; 55/521, 524, 528, DIG. 5, DIG. 39

(56) References Cited

U.S. PATENT DOCUMENTS

| | | | | |
|---|---|---|---|---|
| 3,550,257 | A | 12/1970 | Brown et al. | 96/66 X |
| 3,594,863 | A | 7/1971 | Erb | 425/505 |
| 3,783,588 | A | 1/1974 | Hudis | 55/DIG. 39 |
| 4,215,682 | A | 8/1980 | Kubik et al. | 55/DIG. 39 |
| 4,234,324 | A | 11/1980 | Dodge, Jr. | 55/DIG. 5 |
| RE30,782 | E | 10/1981 | Van Turnhout | 264/DIG. 48 |
| 4,313,741 | A | 2/1982 | Masuda et al. | 96/78 |
| RE31,285 | E | 6/1983 | Van Turnhout et al. | 55/DIG. 39 |
| 4,592,815 | A | 6/1986 | Nakao | 264/436 X |
| 4,668,558 | A | 5/1987 | Barber | 428/156 |
| 4,775,310 | A | 10/1988 | Fischer | 425/378.1 X |
| 4,894,060 | A | 1/1990 | Nestegard | 604/391 |
| 4,950,549 | A | 8/1990 | Rolando et al. | 525/283 X |
| 5,057,710 | A | 10/1991 | Nishiura et al. | 307/400 |
| 5,069,403 | A | 12/1991 | Marentic et al. | 244/130 |
| 5,077,870 | A | 1/1992 | Melbye et al. | 24/452 |
| 5,078,925 | A | 1/1992 | Rolando et al. | 156/167 X |
| 5,133,516 | A | 7/1992 | Marentic et al. | 244/130 |
| 5,175,030 | A | 12/1992 | Lu et al. | 428/36.91 X |
| 5,256,231 | A | 10/1993 | Gorman et al. | 156/178 |
| 5,405,434 | A | 4/1995 | Inculet | 96/54 |
| 5,450,235 | A | 9/1995 | Smith et al. | 359/529 |
| 5,472,481 | A | 12/1995 | Jones et al. | 96/15 |
| 5,496,507 | A | 3/1996 | Angadjivand et al. | 55/DIG. 39 |
| 5,514,120 | A | 5/1996 | Johnston et al. | 604/378 |
| 5,691,846 | A | 11/1997 | Benson, Jr. et al. | 359/530 |
| 6,280,824 | B1 * | 8/2001 | Insley et al. | 55/521 X |

FOREIGN PATENT DOCUMENTS

| | | |
|---|---|---|
| JP | 56-10312 | 2/1981 |
| JP | 56-10313 | 2/1981 |
| JP | 56-10314 | 2/1981 |
| JP | 7-144108 | 6/1995 |
| JP | 7-241491 | 9/1995 |
| JP | 10-174823 | 6/1998 |
| WO | WO 98/22222 | 5/1998 |
| WO | WO99/65593 | 12/1999 |
| WO | WO00/44472 | 8/2000 |

* cited by examiner

*Primary Examiner*—Richard L. Chiesa
(74) *Attorney, Agent, or Firm*—Gary L. Griswold; Robert W. Sprague; William J. Bond

(57) ABSTRACT

An electrostaticly charged filtration media is provided including a plurality of polymeric structured polymeric film layers having a structured surface defined on at least one face of each structured film layer forming at least in part flow channels. The plurality of structured film layers are configured as a stack with the structured surfaces defining a plurality of ordered inlets open through a face of the stack that are in fluid communication with ordered fluid pathways. Each fluid pathway is defined at least in part by at least one discrete flow channel such that fluid can flow substantially unimpeded from one of the inlets to an outlet opening at another face of the stack. A layer of fluid pathways is defined by two opposing charged film layers at least one of which is a structured film layer. The flow channels have an average height of from 0.1 mm to 5 mm and an average width of from 0.05 mm to 50 mm and an average aspect ratio of from 0.5 to 10.

48 Claims, 5 Drawing Sheets

STRUCTURED SURFACE FILTRATION MEDIA ARRAY

The present invention relates to a filtration media and device comprising at least a layer having a structured surface that defines highly ordered fluid pathways.

BACKGROUND OF THE INVENTION

A variety of filtration devices are used to remove particulate contaminates, including dust particles, mists, smoke particles and the like from gaseous carrier materials, and particularly from air (hereinafter collectively referred to as "air"). Certain of these filter devices rely on particle capture based on charges inherently or actively induced on the particles. With the active charge devices or electrofilters generally there is a charge emitter or ionizer that actively transfers charges to the particles. A collection cell or device, that is typically also actively charged or provided with a potential, is coupled with the charging device to capture the charged particles. These electrostatic air filters have demonstrated improved collection efficiencies for small particulate materials as compared to conventional mechanical filtration devices.

Electrofilters are widely used today for industrial gas cleaning in the removal of particles smaller than 20 microns. Electrofilters employ ionization or other charge emitting sources and forces from electric fields to promote the capture of particles in high flow-through, low pressure drop systems. The electrofilters can be either a single-stage device, wherein the ionization source and collection electrode are combined in a single element, or more commonly a two-stage device that employs an upstream ionization source that is independent of a down stream particle collection stage. Functional attributes such as relatively high efficiency and low pressure drop make two-stage electrofilters particularly well suited for in-door air quality enhancement applications. However these devices are relatively expensive, require periodic cleaning (which is often difficult) and can become odorous over time. The collector performance is also negatively impacted by the deposited particles and can deteriorate over time.

In two stage electrofilter devices, particulates are generally charged as the particulate-laden gas stream is passed between a high-voltage electrode and a ground that are maintained at a field strength sufficient to establish a glow discharge or corona between the electrodes. Discharged gas ions and electrons generated in the corona move across the flow stream, colliding with and charging particulate contaminants in the gas stream. This mechanism, which is known as bombardment or field charging, is principally responsible for charging particles greater than 1 micron in size. Particulates smaller than about 0.2 microns are charged by a second mechanism known as diffusion charging, that results from the collection of gas ions on particles through thermal motion of the ions and the Brownian motion of the particles.

If a dielectric or conductive particle is placed in the path of mobile ions a proportion of the surface of each particle will be given a strong electrical charge. That charge is redistributed over the surface of a conductive particle almost instantaneously whereas it is only very slowly redistributed over the surface of a non-conductor particle. Once charged, particulate contaminants are moved toward the collector surface as they enter the particle collection stage. In the absence of mobile ions, conductive particles captured on the collector surface are free to leave the surface because they have shared their charge with the surface. On the other hand, dielectric and/or non-conducting particles that do not readily lose their charge are retained on the collector surface. This attraction force weakens, however, as layers of particles build up and, in effect, create an electrical insulation boundary between particles and the collector surface. These charge decoupling mechanisms, in combination with flow-stream induced dynamic motion at the collector surface, can lead to disassociation of particulate materials from the collector. Once disassociation from the collector surface occurs, the particle is free to reentrain itself in the air stream.

Electrofiltration devices that rely on electrostatic attraction between contaminant particles and charged collector surfaces are generally exemplified by collectors formed from actively charged conductive (metallic or metalized) flat electrode plates separated by dielectric insulators such as described in U.S. Pat. No. 4,234,324 (Dodge, Jr.) or U.S. Pat. No. 4,313,741 (Masuda et. al.). With these devices, inherently charged particles, or particles induced with a charge, such as by an ionizer or charge emitter as described above, are passed between flat charged electrode collector plates. Dodge proposes use of thin metalized Mylar sheets separated by insulating spacers on the ends of the sheets and wound into a roll. These constructions are described as lower cost than conventional metal plates and can be powered by low voltage sources, which, however, require closer spacing of the metalized sheets. This construction allegedly is of a cost that would permit the collector to be discarded rather than requiring periodic cleaning. Additionally, this construction would also eliminate the odor problem. Masuda et. al. also describes the above problems with conventional metal plates and proposes a specific plate design to address the problems of sparking and some of the loss in efficiency problems, but periodic cleaning is still required and odors are still a problem.

In an effort to provide serviceable electrofiltration devices that do not require periodic cleaning, U.S. Pat. No. 3,783,588 (Hudis) describes the use of films of permanently electrically charged polymers that move on rolls into and out of the collector. In this construction, new, uncontaminated, charged film is constantly moved from one roll into the collector space and dirty film is moved out of the collector space onto a collector roll. Periodically the film rolls must be replaced, which would be time consuming, particularly where large numbers of film rolls are employed.

Also used are passively charged disposable filters where the filter media is charged. These provide improved filtration performance relative to particles that have some charge or polarity at relatively low pressure drops. These charged filter media are generally nonwoven or woven fibrous filters where particles impact a face of the media and pass through the fibrous media. Efficiency and lifetime particle capacity are typically increased by increasing the basis weight of the media, which correspondingly increases pressure drop. This pressure drop increase can cause significant problems in situations where a fairly constant flow of air is important, such as some electronic devices, air conditioners and automotive environments.

There has been proposed as a method of decreasing this increase in flow resistance, and associated pressure drop, using filters where the fluid flows over the face of the filter media and not through the media. This is done by creating flow through channel filters where the flow channels sidewalls are formed by otherwise conventional particulate or sorbent filter media. Particles are captured when they contact these filter media sidewalls. As the air flows along the face of the filter media rather than through it, there is generally no dramatic increase in pressure drop over, the filter's useful life. In view of its increased particle capture capabilities, generally the particulate filtration media used in these constructions are electret charged fibrous media, generally a nonwoven filter media formed of charged fibers. For example, Japanese Kokai 7-144108 (published Jun. 6, 1995) indicates that it is known to form honeycomb shaped filters (e.g., pleated corrugated filter media resembling corrugated cardboard) from electret charged nonwoven filter media. This patent application proposes increasing the long term efficiency of such a filter structure by forming it from a filter media laminate of charged meltblown fiber filter media and charged split fiber filter media (e.g., similar to filter media disclosed in U.S. Pat. No. RE 30,782). Japanese Kokai 7-241491 (published Sep. 19, 1995) proposes a honeycomb filter, as above, where the pleated layers and the flat layers forming the corrugated honeycomb structure are alternating layers of electret charged nonwoven filter media and sorbent filter media (an activated carbon loaded sheet or the like), the activated carbon layer preferably is formed with a liner (e.g., a nonwoven) that may also be electret charged. Japanese Kokai 10-174823 (published Jun. 30, 1998) discloses another honeycomb type filter, as above, where the filter material forming the honeycomb structure is formed from a laminate of an electret charged nonwoven filter layer and an antibacterial filter layer. These honeycomb type filters are described as advantageous for uses where low pressure drop is critical and single pass filtration efficiency is less important; for example, recirculating type filters such as used in air conditioners, room air cleaners or the like. Generally, these honeycomb filters are formed by a process similar to that used to form cardboard where one filter media is pleated and glued at its peaks to a flat layer. The assemblies are then stacked or rolled up where adjacent laminate layers can be joined by glue or hot melt adhesive. The filtration media is charged by conventional techniques prior to forming the honeycomb structures.

A different approach to a flow through type filter is proposed in U.S. Pat. No. 3,550,257 where the charged filtration media is a film rather than a nonwoven filter media. The charged flat films in this patent are separated by spacers strips that are described as open cell foam webs of glass fibers or corrugated Kraft paper. The pressure drop is described as dependent on the porosity of the spacers and the space between the charged dielectric films. Japanese Kokai 56-10314 (published Feb. 2, 1981) discloses a similar structure where a corrugated honeycomb structure is formed with either, or both, the pleated or flat layers are formed from a charged polymeric film (film is defined either as a film or a nonwoven). The layers are adhered by melting the front edges of the multilayer structure together. It is disclosed that the film is imparted with "wrinkles" by the folding process. Similar "film" type honeycomb structures, formed from charged "films", are further disclosed in related Japanese Kokai 56-10312 and 56-10313, both published Feb. 2, 1981.

Improved versions of these flow through channel filters are proposed in PCT publications WO99/65593 and WO00/44472 using film based channel filters where the films have large or high aspect ratio surface structures. These surface structures can either define the channels (WO99/65593) or provide enhanced performance in a channel filter formed by a pleated or corrugated film (WO00/44472).

SUMMARY OF THE INVENTION

The present invention provides an improved filtration media or a particle collection element for an electrofiltration apparatus comprising multiple film layers having structured surfaces which structures define particular ordered fluid pathways. The filtration media of the present invention generally comprises a stack of these structured film layers. The structured surfaces defining highly ordered arrays of filter openings and fluid pathways, of a filtration layer, through the assembled filtration media.

The structured surfaces of the film layers may comprise features defining channels that form the fluid pathways, or may comprise features, such as discrete protuberances, that form the fluid pathways with other elements. The filtration media can be produced in a high variety of configurations to meet the filtration requirements of a given application. This variety is manifested in the structured surface feature possibilities—discrete channels, open channels, or protuberances; channel configurations—wide, narrow, 'V' shaped, and/or sub-channels; stack configurations—bonded or unbonded, facing layers, non-facing layers, added layers, aligned channels, offset channels, and/or channel patterns; and filter openings—pore size, pore configuration, or pore pattern. In addition, the layers may be treated for enhanced filtration or other purposes. Generally, the channels formed have a rectilinear cross-section with average channel heights of from 0.1 to 5 mm and average channel aspect ratios of from 0.5 to 10, the aspect ratio being the ratio of the average channel width to height.

The filtration media is formed from at least one polymeric layer having a structured surface defined within or on it. Film layers are configured as a stack with the structured surfaces of the layers defining a plurality of ordered inlets open through a face of the stack and corresponding ordered fluid pathways. The inlets and fluid pathways are formed by the structured surface with a cap layer. The cap layer may be an unstructured layer or a layer with a structured surface.

In a preferred embodiment, the primary flow channels are preferably defined by a series of peaks, each having at least two sidewalls on a film layer. The peaks are separated by a floor, which may have sub-peaks or other sub-structures which can form structures within the primary flow channels. The fluid pathways of a layer within the filtration media is formed at least in part by a structured surface and may be all the same or may be different. Each filtration layer of the filtration media may have the same flow channel configuration, or may be different. The fluid pathways on adjacent filtration layers may be aligned or may be offset.

Additional layers may be added to the stack of film layers. A cap layer may cover a portion of the top of a structured film layer, and additional functional layers may be placed between adjacent layers of the stack. The layers of the stack, may be bonded together. The film layers may be formed from the same or different polymeric materials. The filtration media individual film or other layers may be treated to enhance particle removal or to provide other benefits such as providing oil and water repellency, removing odors, removing organic matter, removing ozone, disinfecting, drying, and introducing fragrance. Treatment generally includes charging of the film layers to form an electret with optional surface coating of certain layers, or the addition of treated layers.

The invention filtration media is particularly useful as a disposable particle collection cell or stage of an electrofiltration apparatus with an ionizer stage. The structured film layer has a first face and a second face, at least one face of the structured film forms, at least in part, flow channels and has high aspect ratio structures over at least a portion of the face forming the flow channels which structures at least in part define the flow channels which in turn define the fluid pathways. A second film layer (comprising the flow channel layer second layer), or a further layer, at least in part, also defines the ordered fluid pathways with the flow channels of the structured film layer. The flow channel layer and the opposing film layers forming the fluid pathways are electret charged.

DETAILED DESCRIPTION OF THE PREFERRED EMBODIMENT

The present invention provides a filtration media array or collector cell comprised preferably of electret charged structured films arranged in a stacked structure to form ordered fluid flow pathways. The structured film layers have high aspect ratio structures such as ribs, stems, fibrils, or other discrete protuberances that at least in part form flow channels that at least in part further define the fluid flow pathways.

The structured film layers are configured in a filtration media array with the film layers defining a plurality of inlets openings into the fluid pathways through a face of the filter media or collector array. The fluid pathways may be defined by a single structured film layer with flow channels having a cap film layer, or by adjacent structured film layers. The fluid pathways further have outlet openings which allow fluid to pass into and through the fluid pathways without necessarily passing through a filter layer having a flow resistance. The fluid pathways and openings of the filtration media array as such are defined by one or more flow channels formed at least in part by the structured film layers. The flow channels are generally created by peaks or ridge structures in the structured film layer and can be any suitable form as long as they are arranged to create fluid pathways in conjunction with an adjacent layer through the filtration media array. For example, the flow channels can be separate discrete channels formed by repeating ridges or interconnected channels formed by peak structures. The flow channels could also be isolated channels (e.g., closed valleys surrounded by peaks or ridges) that together with a further structured film layer define a fluid pathway.

A plurality of adjacent, either separate or interconnected, flow channels are preferably defined by a series of peaks or ridges formed by a single structured film layer. These adjacent flow channels define a flow channel layer. The peaks or ridges in the structured film layers may be stabilized or separated by a cap layer. A cap layer is a layer which is in engagement, or contact, with the peaks or ridges on one face of the structured film layers. A cap layer may cover all or only a portion of a structured film layer. If the cap layer is a planar film layer, the cap film layer and the associated structured film layer define fluid pathways between adjacent peaks or ridges of the structured film layer in contact or engagement with the film cap layer.

Figure 1:
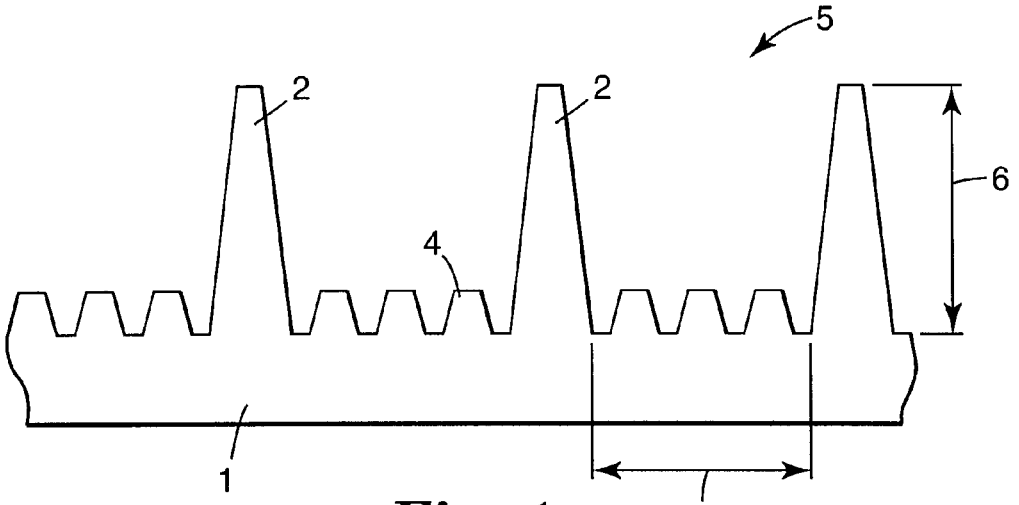
FIG. 1 is a side view of a first structured film flow channel layer useful in forming the collector cell according to the invention.

The structured film layers and optionally the cap film layers, may have structured surfaces defined on one or both faces. The high aspect ratio structures schematically illustrated in FIGS. 1 and 2, used on the structured film and/or cap film layers of the preferred embodiments generally are structures which define flow channels where the ratio of width (8) at the channel base to the smallest diameter or height (6) is greater than 0.5, preferably greater than 1.0, preferably up to 6, where the structure has a height of at least about 0.1 mm and preferably at least 0.5 mm. The fluid pathways formed by the flow channels generally have an average aspect ratio of from 0.5 to 10, preferably 1 to 6 for optional performance. The structures on the film layers 1 can be in the shape of upstanding stems or projections, e.g., pyramids, cube corners, and could also be J-hooks, mushroom heads, or the like; continuous or intermittent ridges; e.g., rectangular 3 or v-shaped ridges 2 with intervening channels 5; or combinations thereof. These structures can be regular, random or intermittent or be combined with other structures. The ridge type structures can be regular, random intermittent, extend parallel to one another, or be at intersecting or nonintersecting angles and be combined with other structures between the ridges, such as nested ridges 4 or projections. Generally, the high aspect ratio structures can extend over all or just a region of a structured film 1. When present in a film region, the structures provide a surface area at least 50 percent higher than a corresponding planar film, preferably at least 100 percent higher, generally up to 1000 percent or higher. In a preferred embodiment, the high aspect ratio structures are continuous or intermittent ridges that extend across a substantial portion of the film layer.

The structured surfaces can be made by any known method of forming a structured film, such as the methods disclosed in U.S. Pat. Nos. 5,069,403 and 5,133,516, both to Marantic et al.; U.S. Pat. No. 5,691,846 to Benson et al.; U.S. Pat. No. 5,514,120 to Johnston et al.; U.S. Pat. No. 5,175,030 to Lu et al.; U.S. Pat. No. 4,668,558 to Barber; 4,775,310 to Fisher; U.S. Pat. No. 3,594,863 to Erb or U.S. Pat. No. 5,077,870 to Melbye et al. U.S. Pat. No. 4,894,060 describes a method of profile extrusion of continuous rib structures which is a preferred method of forming continuous longitudinally extending structures in accordance with the invention. These profile extruded structured films could be oriented in the machine direction to reduce the film basis weight or the dimensions of the film and its structures. Alternatively, as disclosed in the patent, the ribs can be cut prior to orientation forming projections or stems. These methods are all incorporated by reference in their entirety.

Figure 3:
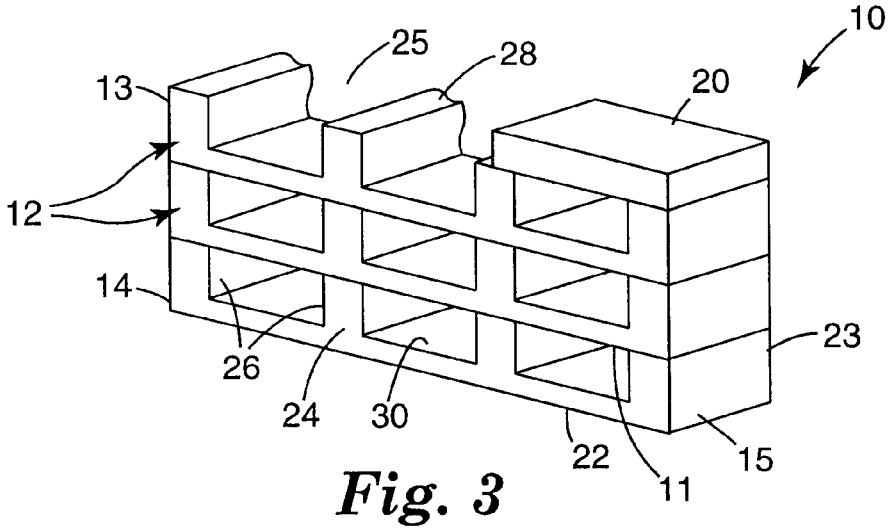
FIG. 3 is a perspective view of a stack of layers having structured surfaces forming a filtration media in accordance with the present invention.
Figure 4:
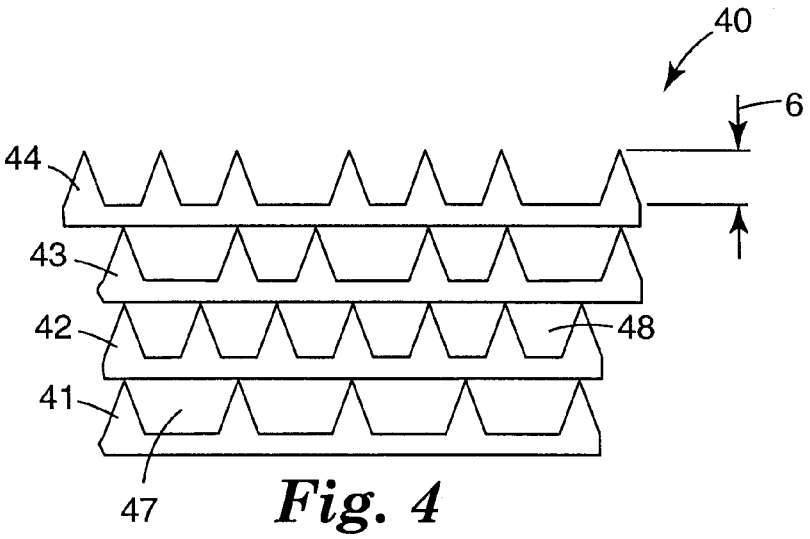
FIG. 4 is an end view of stacked film layers having structured surfaces illustrating an alternative layer configuration that may be used for filtration media in accordance with the present invention.

FIGS. 3 and 4 illustrate filtration media or collector cells 10, that includes stacked structured film layers 12. Each layer 12 has a structured surface 13 on at least one of its two major surfaces, where a structured surface 13 comprises a surface with a topography (the surface features of an object, place or region thereof). In this embodiment, the structured surfaces 13 comprise a plurality of channels 25 formed within the layers 12 preferably, as shown, in a consistent, ordered manner. These flow channels 25 are defined by a series of peaks 28 that form sidewalls 26 with or without a planar floor 30 in-between them. Together the stacked layers 12 form a three dimensional, highly ordered, porous filtration media 10 wherein fluid, such as air, can flow through the media 10 via ordered fluid pathways, as defined by the flow channels 25, so that particulate or other matter can be removed from the fluid by adherence to film surfaces. By ordered, it is meant that the pathways defined through the media are predetermined. Each pathway need not be the same as another of the same layer or a different layer. Each pathway is, however, predetermined in the sense that each pathway is set by a predetermined design of the structured surface 13 of each layer 12 (i.e., not random as would be a fibrous filter) such that substantially identical and reproduceable arrangements of pathways can be produced on multiple filtration media arrays.

The layers 12 may each comprise similar or different flexible, semi-rigid, or rigid material which can be subject to an induced charge, or is chargeable. The layers are chosen depending on the particular application of the filtration media 10. Preferably, each of the layers 12 comprise a chargeable polymeric material, because such material is typically less expensive and because such polymeric material can be accurately formed with a structured surface 13. The use of a polymeric layer 12 in the form of, for example, a film layer can provide a structured surface defining a large number of and high density of fluid flow channels 25 on a major surface thereof. Thus, a highly ordered porous filtration media of the invention is amenable to being manufactured with a high level of accuracy and economy.

As shown in FIGS. 3 and 4, this filtration media or collector cell 10 is formed by stacking of the layers 12, one on top of another. In this manner, any number of layers 12 can be stacked together to form a filtration media 10 having adequate height and filtration area for the particular application. One advantage of direct stacking of structured film layers 12 on each other is that the second major surface 11 of each layer 12 serves as a cap layer for the channels 25 of the lower adjacent structured film layer 12. Therefore, each channel 25 may become a discrete pathway for fluid flow through the filtration media 10.

A structured film layer 12 surface 11 may be bonded to the peaks 28 of some or all of the structured surface 13 of an adjacent layer to enhance the creation of discrete pathways from the channels 25. This can be done using conventional adhesives that are compatible with the materials of the layers 12, or this can be done using heat bonding, ultrasonic bonding, mechanical devices, or the like. Bonds may be provided entirely along the peaks 28 to the adjacent surface 11, or may be spot bonds provided in accordance with an ordered pattern, or randomly. Alternatively, the layers 12 may simply be stacked upon one another whereby the structural integrity of the stack adequately enhances the creation of discrete flow channels 25.

To close off some, but preferably all of the channels 25 of an uppermost layer 12, a cap layer 20 may also be provided, as shown in FIG. 3 This cap layer 20 may be bonded or unbonded in the same or a different manner as the inter-layer bonding described above. The material for cap layer 20 can be the same or different from the material of the layers 12.

Figure 5:
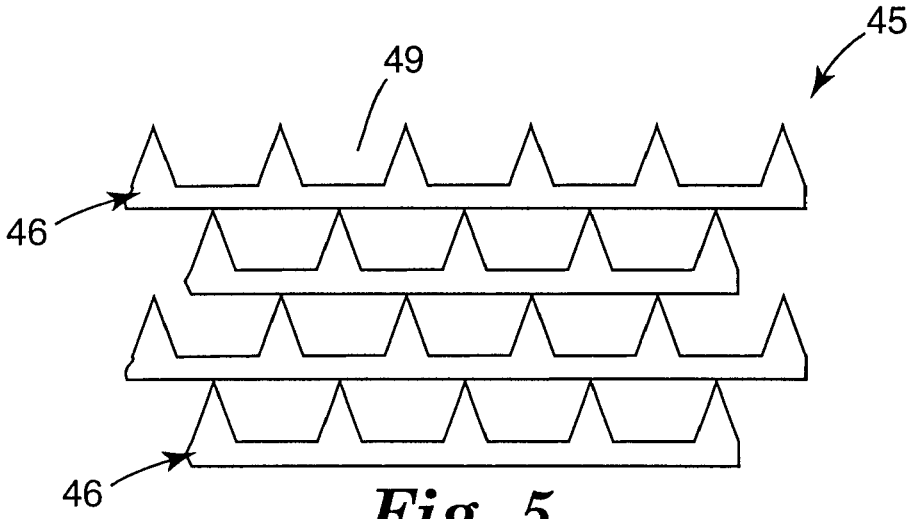
FIG. 5 is an end view of stacked layers having structured surfaces illustrating another alternative layer configuration that may be used for filtration media in accordance with the present invention.

The embodiments of the filtration media or collector cell 10 shown in FIG. 3 comprises ordered linear channels. These channels may be aligned in a precise array, that is the channels of each layer line up with the channels of the other layers, thereby presenting a regular, aligned pore pattern. Alternatively, these channels may be offset in a regular, repeating manner, or they may be offset in a controlled manner such as shown in FIG. 4 or 5. In addition, other channel and layer configurations are contemplated.

FIG. 4 illustrates an embodiment where each layer 41 to 44 of filtration media of collector cell 40 has a different channel configuration, and the layers 41 to 44 are arranged in varying repeat patterns with respect to each other. As can be seen, layer 41 comprises consistent wide channels 47, layer 42 comprises narrower consistent channels 48, layer 43 comprises a repeating pattern of wide 47 then narrow 48 channels, and layer 44 comprises a repeating pattern of two narrow 48, then one wide 47 channels. Channel repeat patterns could also be random, or the selection of layers comprising the stack could be done in a pattern or in a random fashion. In any case, these configurations would still create ordered pathways because the opening sizes and channel structures formed would be as expected or designed and not random. FIG. 5 illustrates an embodiment of a filtration media 45 wherein the channels 49 of each layer 46 are consistent, but the relationship of the layers 46 to each other is an alternating pattern. The choice of channel configurations, number of channels, and or layer relationships depends on the particular application for which the filtration media is desired.

Figure 8:
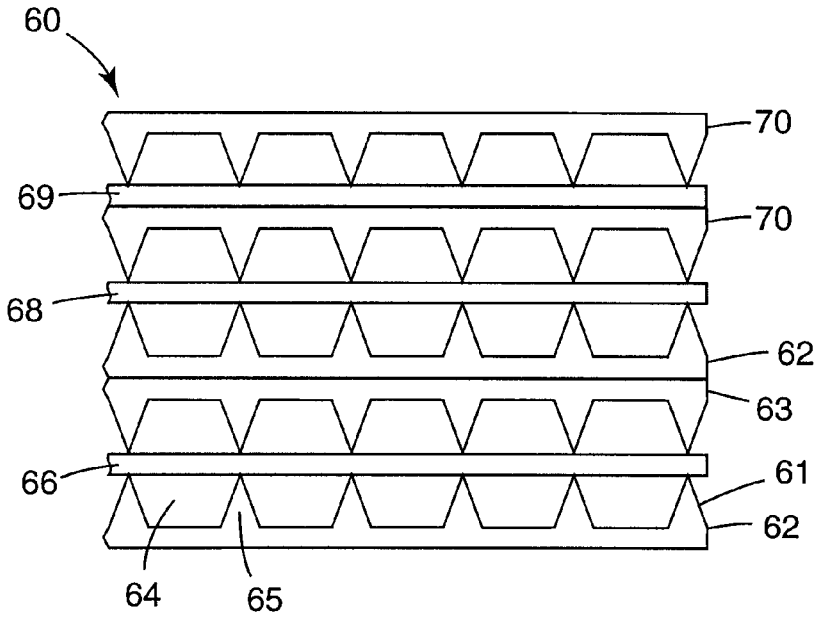
FIG. 8 is an end view of a stack of layers having structured surfaces with additional layers interposed between facing and non-facing layers.

FIG. 8 illustrates an embodiment wherein filtration media or collector 60 comprises similar layers 62, 63 and 70 having channels 64 defined by peaks 65 within structured surface 61. However, the layers 62, 63 and 70 differ in their orientation and repeat pattern with respect to each other. Layer 62 is an upward facing layer, whereas layers 63 and 70 are downward facing layers. These layers 62, 63 and 70 are all arranged in a varying stack configuration, including additional layers 66, 68 and 69. As illustrated, layers may be arranged to face one another, may be back-to-back, or may be stacked in the same orientation. In addition, the repeat pattern with respect to one another can provide for aligned channels or offset channels, in numerous variations. As is evident from FIGS. 4, 5 and 8, the channel and layer configurations available with the present invention provide versatility and adaptability to meet any filtration requirement.

Although the embodiment of FIG. 3 is shown with structured surfaces 13 comprising multiple peaks 28 and wide floors 30, continuously provided from one side edge 14 to the other side edge 15, other channel configurations are contemplated. In most cases, it will be desirable to provide a series of peaks 28 entirely from one edge 14 of the layer 12 to the other edge 15; however, for some applications, it may be desirable to extend the peaks 28 only along a portion of the structured surface 13 on any given layer 12. In addition, a specific application for the filtration media 10 may determine the number, type and size of the channels 25 provided to meet the filtration requirements.

Figure 6:
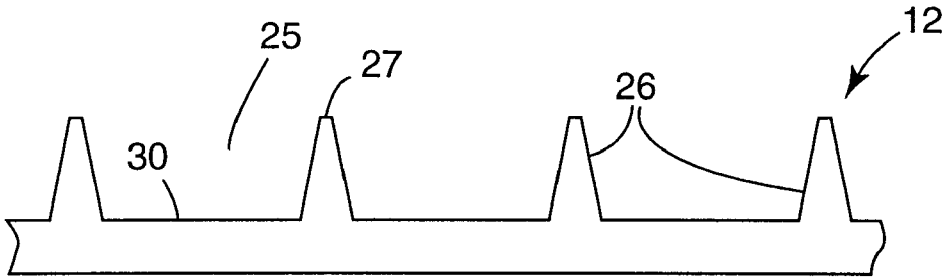
FIG. 6 is an end view of a layer having a structured surface illustrating another channel configuration that may be used for filtration media in accordance with the present invention.
Figure 7:
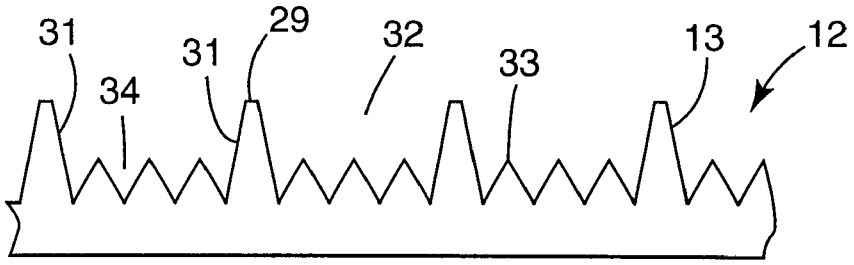
FIG. 7 is an end view of a layer having a structured surface illustrating yet another channel configuration that may be used for filtration media in accordance with the present invention.

In FIG. 6, the channels 25 are defined by a continuous series of peaks 27 that are separated by a wide, flat floor 30. Each peak 27 is flattened at the top, thereby facilitating bonding to an adjacent layer. In FIG. 7, wide channels 32 are defined between peaks 29, but instead of providing a planar floor between channel sidewalls 31, a plurality of smaller sub-peaks 33 are provided. These sub-peaks 33 thus define secondary channels 34 therebetween. The peaks 29 and sub-peaks 33 need not be evenly distributed with respect to themselves or each other. This configuration has the added advantage of increasing the amount of channel surface area upon which particulate matter may impinge during filtration. Moreover, the smaller channels 34 can be used to control fluid flow through the wider channels 32.

Although the figures illustrate elongated, linearly-configured channels, the channels may be provided in many other configurations. For example, the channels could have varying cross-sectional widths along the channel length; that is, the channels could diverge and/or converge along the length of the channel. The channel sidewalls could also be contoured rather than being straight in the direction of extension of the channel, or in the channel height. Generally, any channel configuration that can provide at least multiple discrete channel portions that extend from a first point to a second point within the filtration media are contemplated.

Referring back to FIG. 3, at least some, if not all of the channels 25 are open on the face side 22 of the filtration media or collector cell 10, forming pores in the face surface 24. Fluid passes into the filtration media 10 at the face surface 24, preferably traveling through the channels 25 and exiting at the back side 23 of the filtration media 10. At a minimum, the structured surfaces of the present invention provide controlled and ordered fluid pathways through the filtration media. The amount of surface area available for filtration purposes is therefore determined by the volume of the filtration media. In other words, the structured surface features of the filtration media layers, such as the length of the channels and the channel configurations, define the useable surface area, and not just the face surface.

In order to enhance filtering capabilities or to effect a desired result, the inventive filtration media or collector cell may be treated in numerous ways. One treatment example is shown in FIG. 8. Filtration media 60 comprises a stack of layers 62, 63 and 70. Interposed between facing layers 62 and 63 is an additional layer 66 serving as a cap layer for at least some of the channels 64 of each layer 62 and 63. More than one type of additional layer may be provided between subsequent groupings of facing layers, as shown by additional layers 66 and 68. In addition, the same or different additional layers 69 may be provided between non-facing layers 70 to improve particle removal or provide other benefits. Any type, size, configuration and relationship of structured surface features are contemplated for use with additional layers 66, 68 or 69. These additional layers 66, 68 and 69 may be formed of the same or similar material as the other structured layers 62, 63 or 70, or they may comprise other materials that may provide enhanced particle removal or other desired benefits, and are effective for the purpose contemplated.

Materials that enhance particle removal or achieve other desired benefits may include, either alone or fixed to a substrate: adsorbents, such as activated carbon, zeolite or aluminosilicate for removing organic molecules or deodorization; deodorizing catalysts such as copper-ascorbic acid for decomposition of malodorous substances; drying agents such as silica gel, zeolite, calcium chloride, or active alumina; a disinfecting agent such as a UV germicidal system; fragrances such as gloxal, methacrylic acid esters or perfumes; or ozone removing agents including metals such as Mg, Ag, Fe, Co, Ni, Pt, Pd, or Rn, or an oxide supported on a carrier such as alumina, silica-alumina, zirconia, diatomaceous earth, silica-zirconium, or titania. Any of the listed materials, and others which are not listed but would be suitable to meet a desired purpose and be effective with the present invention, may be used in any combination.

The filtration media or collector cell layers of the present invention are electrostaticly charged which includes passive electrostaticly charged film or film layers or actively electrostaticly charged layers. Electrostatic charging enhances the filtration media's ability to remove particulate matter from a fluid stream by increasing the attraction between particles and the surface of the structured surfaces, thus enhancing the third mechanism for particle removal. Non-impinging particles passing close to sidewalls are more readily pulled from the fluid stream, and impinging particles are adhered more strongly. Passive electrostatic charging is provided by an electret, which is a dielectric material that exhibits an electrical charge that persists for extended time periods. Electret chargeable polymeric materials include nonpolar polymers such as polytetrafluoroethylene (PTFE) and polypropylene. Generally, the net charge on an electret is zero or close to zero and its fields are due to charge separation and not caused by a net charge. Through the proper selection of materials and treatments, an electret can be configured that produces an external electrostatic field.

Several methods are used to charge dielectric materials, any of which may be used to charge the filtration media of the present invention, including corona discharge, heating and cooling the material in the presence of a charged field, contact electrification, spraying the web with charged particles, and impinging a surface with water jets or water droplet streams. In addition, the chargeability of the surface may be enhanced by the use of blended materials. Examples of charging methods are disclosed in the following patents: U.S. Pat. No. RE30,782 to van Turnhout et al., U.S. Pat. No. RE31,285 to van Turnhout et al., U.S. Pat. No. 5,496,507 to Angadjivand et al., U.S. Pat. No. 5,472,481 to Jones et al., U.S. Pat. No. 4,215,682 to Kubik et al., U.S. Pat. No. 5,057,710 to Nishiura et al. and U.S. Pat. No. 4,592,815 to Nakao.

Types of active charging include the use of a film with a metalized surface on one face that has a high voltage applied to it or placing chargeable conductive material between structured film layers of the filter media array. A metalized surface on a film could be accomplished in the present invention by the addition of such a metalized layer adjacent a structured layer, or the application of a metal coating on the nonstructured surface of a structured layer. Filtration media comprising such metalized layers or adjacent conductive layers could then be mounted in contact with an electrical voltage source resulting in electrical potential forming between adjacent conductive material layers. Examples of such active charging are disclosed in U.S. Pat. No. 5,405,434 to Inculet.

Filtration media layers for any of the embodiments of the present invention can be formed from a variety of preferably electrostaticly chargeable polymers or copolymers including thermoplastic, thermoset, and curable polymers blends or layers containing these polymers. As used here, thermoplastic, as differentiated from thermoset, refers to a polymer which softens and melts when exposed to heat and re-solidifies when cooled and can be melted and solidified through many cycles. A thermoset polymer, on the other hand, irreversibly solidifies when heated and cooled. A cured polymer system, in which polymer chains are interconnected or crosslinked, can be formed at room temperature through use of chemical agents or ionizing irradiation. Chargeable polymers useful in forming any of the structured layers or articles of the invention include but are not limited to polyolefins such as polyethylene and polyethylene copolymers, polyvinylidene diflouride (PVDF), polytetrafluoroethylene (PTFE) polyesters and/or polystyrenes or blends or layers containing these polymers. Structured layers can be cast from curable resin materials and cured through free radical pathways promoted chemically, by exposure to heat, UV, or electron beam radiation.

There are applications where flexible filter media is desired. Flexibility may be imparted to a structured polymeric layer using polymers described in U.S. Pat. No. 5,450,235 to Smith et al. and U.S. Pat. No. 5,691,846 to Benson, Jr. et al. The whole polymeric layer need not be made from a flexible polymeric material. A portion of a layer, for example, could comprise a flexible polymer, whereas the structured portion or portion thereof could comprise a more rigid polymer. The patents cited in this paragraph describe use of polymers in this fashion to produce flexible products that have microstructured surfaces.

Polymeric materials including polymer blends can be modified through melt blending of plasticizing active agents such as surfactants or antimicrobial agents, however, these additives should be limited to noncharged layers if they impact chargeability. Surface modification of the structured surfaces can be accomplished through vapor deposition or covalent grafting of functional moieties using ionizing radiation. Methods and techniques for graft-polymerization of monomers onto polypropylene, for example, by ionizing radiation are disclosed in U.S. Pat. Nos. 4,950,549 and 5,078,925. The polymers may also contain additives that impart various properties into the polymeric structured layer. For example, plasticizers can be added to decrease elastic modulus to improve flexibility.

The invention collector cell can be provided in an electrofiltration device comprising a fan or other means for moving gaseous fluid through the device, an ionization stage, and a collector stage formed of the flow channel layers of the collector cell.

An electrofiltration device relies on a fan or other air movement device or method to move the particulate contaminated gaseous fluid past the upstream ionization stage and/or over the downstream particle collection stage. While the air moving element can be located at either the intake or exhaust ports of the electrofiltration device or connected to the electrofiltration device from a remote location, it is preferable that the air moving element be placed downstream of the collector stage to minimize accumulation of particulate contaminants on the fan elements. Suitable fans include, but are not limited to conventional axial fans or centrifugal fans. Alternatively, particulate contaminated gas could be moved past the upstream ionization stage and over the downstream particle collection stage by moving the ionization and collection elements through the gas by spinning the elements in a volume of contaminated gas. A further means of moving particular contaminated gaseous fluid past the ionizer and through the collection stage would be by simple convection. Air moved by convection currents created by a lamp or radiator could be directed through the device of the invention without the need for any mechanical assist. The low flow resistance of the collection cell of the invention provides for such an application, which, if employed, would have the added benefit of keeping lamp fixtures and radiator surfaces clean.

A typical upstream ionization stage for the filtration device of the invention consists of two electrodes, a charging electrode and a grounding electrode, which are connected to a high voltage power source. In operation, the high voltage source maintains a sufficiently high voltage between the two electrodes to produce a glow discharge or corona between the electrodes. The ionization stage may take one of many different configurations well known in the art to produce glow discharge conditions. The charging electrode may be a needle, a parallel wire grid, a woven mesh grid, etc., and the grounding electrode may be perimeter electrode such as a ring, a conductive honeycomb core or similar configuration. The location of the ionization stage is also flexible in that it can be integral with the fan and collection stage or it can be located remotely from the collection stage and fan. When employed in an air recirculation application, such as a room air purifier, the ionization stage may be placed up or down stream of the collection cell.

The collection stage of the electrofiltration device comprises a filtration media array of the invention configured as a collector cell with the film layers defining a plurality of inlets into fluid pathways through a face of the cell.

The collector cell or filtration media of the present invention starts with the desired materials from which the layers are to be formed. Suitable sheets of these materials having the required thickness or thicknesses are formed generally with the desired high aspect ratio structured surfaces. At least one of these structured film layers is joined to a further layer forming a flow channel layer. The flow channel layers forming the collector cell may be bonded together, mechanically contained or otherwise held into a stable collector cell. The film layers may be bonded together such as disclosed in U.S. Pat. No. 5,256,231 (extrusion bonding a film layer to a corrugated layer or by adhesive or ultrasonic bonding of peaks to an underlying layer), or by melt adhering the outer edges forming the inlet and/or outlet openings. One or more of these flow channel layers 20 is then stacked or otherwise layered and are oriented in a predetermined pattern or relationship, with optionally additional layers to build up a suitable volume of flow channel layers 20 in a collector cell 30 as shown in FIG. 3. The resulting volume of flow channel layers 20 is then converted, by slicing, for example, into a finished collector cell of a desired thickness and shape. This collector cell 30 may then be used as is or mounted, or otherwise assembled into a final useable format. Any desired treatments, as described above, may be applied at any appropriate stage of the manufacturing process. In addition, the collector cell in accordance with the present invention may be combined with other filtering material, such as a layer of nonwoven fibrous material over the face surface, or may be combined with other non-filtering material to facilitate such things as handling, mounting, assembly or use.

Collector cell or filter media array is preferably formed into its final form by slicing the cell with a hot wire. The hot wire fuses the respective layers together as the final filter form is being cut. This fusing of the layers is at the outermost face or faces of the final filter. As such at least some of the adjacent layers of the filter media need not be joined together prior to the hot wire cutting. The hot wire cutter speed can be adjusted to cause more or less melting or fusing of the respective layers. For example, the hot wire speed could be varied to create higher or lower fused zones. Hot wires could be straight or curved to create filters of an unlimited number of potential shapes including rectangular, curved, oval, or the like. Also, hot wires could be used to fuse the respective layers of the collector cell without cutting or separating filters. For example, a hot wire could cut through the collector cell fusing the layers together while maintaining the pieces on either side of the hot wire together. The pieces re-fuse together as they cool, creating a stable collector cell.

Preferred embodiments of the invention use thin flexible polymer films having a thickness of less than 300 microns, preferably less than 200 microns down to about 50 microns. Thicker films are possible but they generally increase the pressure drop of the filter without any added benefit to filtration performance or mechanical stability. The thickness of the other layers are preferably less than 200 microns, most preferably less than 100 microns. The thickness of the layers forming the collector cell generally are such that cumulatively less than 50 percent of the cross sectional area of the collector cell at the inlet or outlet openings is formed by the layer materials, preferably less than 25 percent, more preferably less than 20 percent, most preferably less than 15 percent. The remaining portions of the cross sectional area form the inlet openings or outlet openings. The peaks, ridges or structures of the contoured or structured films forming the flow channels generally have a minimum height of about 0.1 mm, preferably at least 0.5 mm and most preferably at least 1.0 mm.

EXAMPLES

Test Procedures

Filtration Performance

Figure 9:
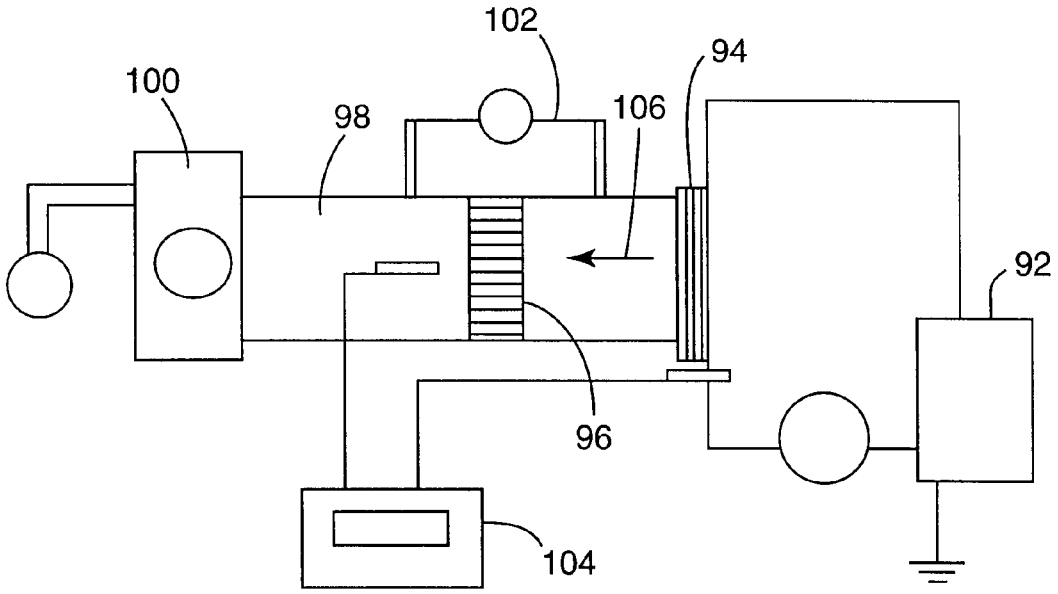
FIG. 9 is a schematic view of an ionizer assisted filter system using the invention filtration media array as a collector cell.

Filtration media were evaluated in an ionization device using a test set-up shown in FIG. 9. The set-up consisted of a high-voltage power supply (92, available as Model R20-B from HIPOTRONICS, Brewster, N.Y.), an ionizer (94, tungsten wire-rod ionizer, 0.1 mm diameter wire; 5 mm rod diameter; 1 mm spacing between rods), a filter 96, a flow duct 98, a blower 100, a pressure drop measurement device (102, available as model MKS 698A11 TRB from MKS Instruments, Inc., Richardson, Tex.) and a particle counter (104, available as model 230 from HIAC/ROYCO, Silver Spring, Md.). The test system employed ambient aerosol as the challenge aerosol. The ionizer was charged to a +7000V, which imparted a positive charge to the particles as they passed through the ionizer. The thus charged particles were introduced into the test duct and through the filter media (air flow direction 106). Particle concentrations upstream and downstream of the filter were measured. All tests were performed at a face velocity of 200 cm/s.

Pressure drop was recorded as the difference in pressure between the upstream and downstream side of the filter and is reported in mm $H_2O$.

The particle penetration through the filter is calculated according to the formula:

$$\text{Penetration} = \left(\frac{\text{Upstream Particle Conception}}{\text{Downstream Particle Concentration}}\right) \times 100\%$$

Filter efficiency is calculated according to the formula:

$$\text{Efficiency} = 100 - \text{Penetration}$$

and Quality Factor ($Q_{factor}$) is calculated according to the formula:

$$Q_{factor} = \frac{-\ln(\text{Penetration}/100)}{\text{Pressure Drop}}$$

wherein Penetration and Pressure Drop are defined above.

Examples 1–18 and Comparative Examples C1–C3

Profile Extrusion Preparation

Polypropylene (PP) homopolymer was extruded into a profile extrusion similar to that described in U.S. Pat. No. 4,894,060, using a single screw extruder (available from Killion Corporation, Cedar Grove, N.J.) having a screw diameter of 64 mm, a screw length/diameter (L/D) ratio of 24/1. Specific PP polymers and polymer/additive compositions used to prepare ribbed films used to prepare filter constructions are detailed in Table 1.

TABLE 1

Resins Used for Making Examples

| Sample ID | Resin | Additives |
|---|---|---|
| 1 | FINA 3276[1] | |
| 2 | FINA 3276 | |
| 3 | FINA 3276 | |
| 4 | FINA 3276 | |
| 5 | FINA 3276 | |
| 6 | FINA 3276 | |
| 7 | FINA 3276 | |
| 8 | FINA 3276 | |
| 9 | FINA 3276 | |
| 10 | FINA 3276 | |
| 11 | FINA 3276 | |
| 12 | FINA 3276 | 0.15% TK100[2] |
| 13 | FINA 3276 & 5% U/C 7C06[3] | |
| 14 | FINA 9704[4] | 0.1% IRGANOX 1425[5] |
| 15 | FINA 9704 | 0.5% RTP |
| 16 | FINA 9704 | 0.5% RTP |
| 17 | FINA 3276 | 0.5% RTP |
| C1 | FINA 3276 | |
| C2 | FINA 3276 | |
| C3 | FINA 3378[6] | |

[1]A 2 melt flow index polypropylene homopolymer available from ATO-FINA Petrochemical, Houston, Texas.
[2]A charge stabilization and biocide additive from Calgon Corporation, Pittsburg, Pennsylvania.
[3]A polypropylene copolymer available from Union Carbide, Corp., Danbury, CT
[4]A 2 melt flow index polypropylene homopolymer available from ATO-FINA Petrochemicals.
[5]A charge stabilization additive available from CIBA GEIGY, Hawthorne, New Jersey.
[6]A 2.8 melt flow index polypropylene homopolymer available from ATO-FINA Petrochemical.

The temperature profile of the extruder barrel was set to increase from approximately 177 to 246° C. along the length of the barrel as detailed in Table 2.

TABLE 2

Profile Extrusion Process Conditions

| | ° F. | ° C. | PSI | N/m² | ft/min | m/s | RPM |
|---|---|---|---|---|---|---|---|
| Zone 1 temp | 350 | 177 | | | | | |
| Zone 2 temp | 450 | 232 | | | | | |
| Zone 3 temp | 475 | 246 | | | | | |
| Gate temp | 455 | 235 | | | | | |
| Adaptor 1 temp | 455 | 235 | | | | | |
| Adaptor 2 temp | 455 | 235 | | | | | |

TABLE 2-continued

Profile Extrusion Process Conditions

| | ° F. | ° C. | PSI | N/m$^2$ | ft/min | m/s | RPM |
|---|---|---|---|---|---|---|---|
| Die temperature west | 450 | 232 | | | | | |
| Die temperature center | 455 | 235 | | | | | |
| Die temperature east | 450 | 232 | | | | | |
| Screw speed | | | | | | | 25–38 |
| Melt temperature | 474 | 246 | | | | | |
| Barrel pressure | | | 3,100 | 21,373,673 | | | |
| Die pressure | | | 2,100 | 14,478,940 | | | |
| Line speed | | | | | 20 | 0.1016 | |
| Chiller temp | 40 | 4 | | | | | |

The polymer was continuously discharged at a pressure of about $1.38\times10^7$ Pa through a neck tube heated to 232–235° C. into an MasterFlex™ 203 mm wide film die (available from EDI Extrusion Die, Inc., Chippewa Falls, Wis.), maintained at a temperature of about 232° C. The die had a die lip configured to form a polymeric base sheet with rib profiles at pre-determined height and spacing as described in Table 3.

TABLE 3

Profile Extruded Ribbed Film Dimensions

| Sample ID | Channel width (μm) | Rib Height (μm) | Aspect Ratio | Solidity[1] |
|---|---|---|---|---|
| 1 | 2,667 | 889 | 3.0 | 23.0% |
| 2 | 2,032 | 1,016 | 2.0 | 21.4% |
| 3 | 3,810 | 1,016 | 3.8 | 18.3% |
| 4 | 3,886 | 1,219 | 3.2 | 16.2% |
| 5 | 3,886 | 1,245 | 3.1 | 14.3% |
| 6[2] | 5,613 | 1,448 | 3.9 | 16.8% |
| 7 | 7,620 | 1,524 | 5.0 | 12.2% |
| 8[3] | 8,382 | 1,524 | 5.5 | 25.7% |
| 9 | 2,540 | 1,651 | 1.5 | 15.4% |
| 10 | 3,759 | 1,778 | 2.1 | 13.1% |
| 11 | 8,128 | 2,032 | 4.0 | 10.5% |
| 12 | 3,810 | 1,219 | 3.1 | 20.6% |
| 13 | 3,759 | 1,118 | 3.4 | 21.3% |
| 14 | 3,810 | 1,016 | 3.8 | 18.3% |
| 15 | 4,699 | 1,016 | 4.6 | 17.6% |
| 16 | 5,969 | 1,016 | 5.9 | 17.0% |
| 17 | 2,667 | 889 | 3.0 | 21.5% |
| C1 | 1,016 | 1,016 | 1.0 | 27.3% |
| C2 | 508 | 508 | 1.0 | 26.4% |
| C3 | 228 | 190 | 1.2 | 50.5% |

1) Samples solidity was determined by weighing the sample, calculating the sample volume from the samples dimensions (length, width and thickness), and calculating the solidity by dividing the sample weight by the product of the polymer density and the sample volume and multiplying the calculated value by 100 to give % solidity.

$$\%\ \text{Solidity} = \left(\frac{\text{Sample weight (gm)}}{\{\text{Polymer density } (\text{gm/cm}^3)\times\text{Sample Volume } (\text{cm}^3)\}}\right)\times 100$$

Figure 10:
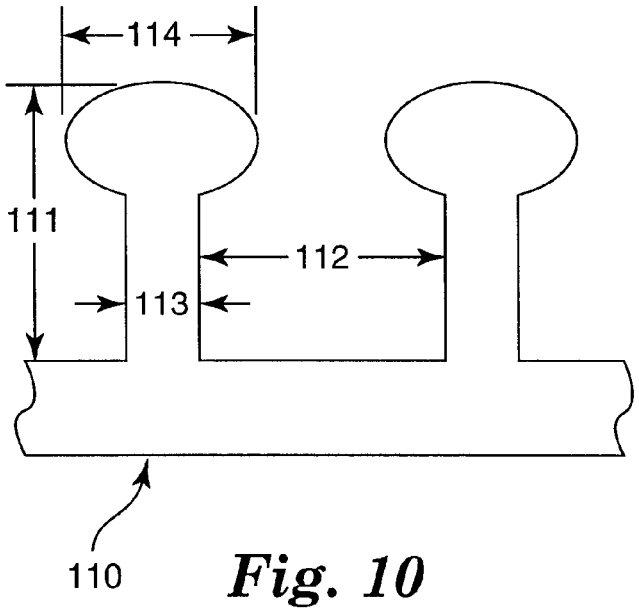
FIG. 10 is an end view of a film layer having structured surfaces in accordance with the present invention.

2) The rib profile of this film 110 is shown in FIG. 10 where the projections or peaks have a stem with a width 113 and a head with a width 114 of 78.2 microns and an overall height 111 of 141.7 microns. The channel width is 112 of 571 microns between the two peaks.

Figure 11:
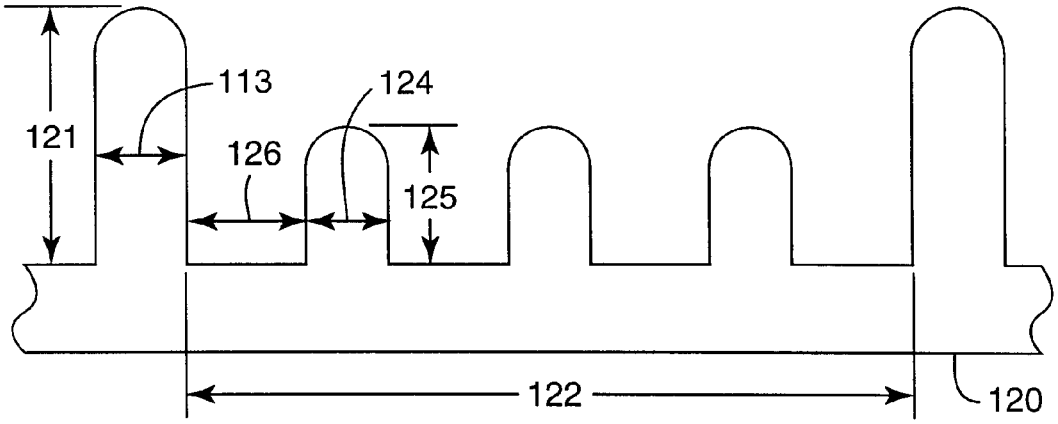
FIG. 11 is an end view of a film layer having structured surfaces in accordance with the present invention.

3) The rib profile of this film is shown in FIG. 11 where the primary projection or peaks have a stem width of 113 of 35.8 microns and a height of 121 of 125.5 microns corresponding to the channel height. The channel width 122 of 789 microns is between two adjacent primary peaks; where secondary peaks having a height 125 of 61 microns and width 125 of 28.4 microns form secondary channels with a width 126 of approximately 178 microns.

Dimensions of the ribbed film configurations used to prepare filter configurations. The extruded ribbed-surface film was drop-cast at a rate of about 10–30 feet/minute into a water filled quench tank maintained at 4.4–7.2° C., and maintained in the tank for at least 10 seconds. On removal from the quench tank, the rib-surfaced film was air-dried and collected on a winder.

Charging Extruded Ribbed Film

The extruded ribbed film was charged using standard electret charging techniques.

Channel Filtration Media Formation

Figure 2:
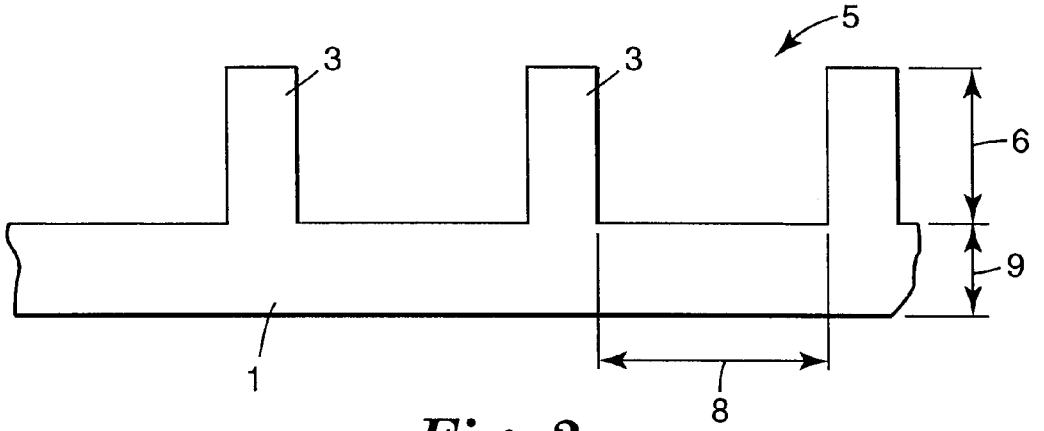
FIG. 2 is a side view of a second embodiment of a structured film flow channel layer according to the invention.

Channel flow filter constructions similar to that illustrated in FIG. 2 were prepared by stacking layers of the extruded ribbed film (0.1 cm×0.38 cm) on top of one another (ribbed side to fat film side), maintaining the channel layers in parallel alignment such that the ribs formed a 90° angle with the plane defined by the inlet opening face of the filter media array (90° incident angle). The ribbed film stack was converted into a stable filtration media array construction by hot-wire cutting the stack to produce filters 5 mm in depth. Cutting was accomplished by traversing the channel assembly stack across an electrical resistance heated 0.51 mm diameter soft-temper nickel chromium wire (available from Consolidated Electric Wire & Cable, Franklin Park, Ill.) at a traverse rate of approximately 0.5 cm/sec. The amount of melting induced by the hot wire and the degree of smearing of melted resin was carefully controlled so as not to obstruct the inlet or outlet openings of the filtration media array. The hot wire cutting operation converted the filter media array into a robust, collapse resistant structure by fusing the inlet and outlet faces of the ribbed film stack together. No additional framing or support components were required to achieve a functional filter media construction.

The particle capture efficiency, pressure drop, and quality factor of the filter media constructions were characterized using Filtration Performance test describe above, the results of which are reported in Table 4.

TABLE 4

Performance of Profile Extruded Channel Filters with Ionizer-Assistance

| Example | Channel width (μm) | Rib height (μm) | Solidity | Channel Shape | Pen, % (@0.5 um) | Efficiency (@0.5 um) | Pres. Drop (mmH2O) | $Q_{factor}$ |
|---|---|---|---|---|---|---|---|---|
| 1 | 2667 | 889 | 23.00% | rectangle | 0.03% | 99.97% | 2.62 | 3.2 |
| 2 | 2032 | 1016 | 21.40% | rectangle | 0.13% | 99.87% | 1.68 | 4 |
| 3 | 3810 | 1016 | 18.30% | rectangle | 0.03% | 99.97% | 1.35 | 6.01 |
| 4 | 3886 | 1219 | 16.20% | rectangle | 0.10% | 99.90% | 1.28 | 5.4 |
| 5 | 3886 | 1245 | 14.30% | rectangle | 0.04% | 99.96% | 1.75 | 4.5 |
| 6 | 5613 | 1448 | 16.80% | T-ribs | 0.14% | 99.86% | 1.06 | 6.2 |
| 7 | 7620 | 1524 | 12.20% | rectangle | 0.17% | 99.83% | 0.8 | 7.97 |
| 8 | 8382 | 1524 | 25.70% | H-LLL-H | 0.09% | 99.91% | 2.53 | 2.8 |
| 9 | 2540 | 1651 | 15.40% | rectangle | 0.62% | 99.38% | 1 | 5.1 |
| 10 | 3759 | 1778 | 13.10% | rectangle | 0.35% | 99.65% | 1 | 5.7 |
| 11 | 8128 | 2032 | 10.50% | rectangle | 18.60% | 81.40% | 0.5 | 3.4 |
| 12 | 3810 | 1219 | 20.60% | rectangle | 0.09% | 99.91% | 1.37 | 5.1 |
| 13 | 3759 | 1118 | 21.30% | rectangle | 0.36% | 99.64% | 1.78 | 3.2 |
| 14 | 3810 | 1016 | 18.30% | rectangle | 0.07% | 99.93% | 1.7 | 4.3 |
| 15 | 4699 | 1016 | 17.60% | rectangle | 0.88% | 99.12% | 1.76 | 2.7 |
| 16 | 5969 | 1016 | 17.00% | rectangle | 0.46% | 99.54% | 1.57 | 3.4 |
| 17 | 2667 | 889 | 21.50% | rectangle | 0.02% | 99.98% | 2.48 | 3.5 |
| C1 | 1016 | 1016 | 27.30% | rectangle | 0.38% | 99.62% | 3.5 | 1.6 |
| C2 | 508 | 508 | 33.20% | rectangle | 0.45% | 99.55% | 5.2 | 1.03 |
| C3 | 228 | 190 | 50.50% | rectangle | 0.05% | 99.95% | 75.1 | 0.101 |

Comparative Example C4

Comparative Example C4 was a commercially available corrugated channel flow filter media based on non-woven electret split fiber web. The corrugated channels were accurate in shape, 1.6 mm high and 2.5 mm at the base. The filter media, as tested, was 100 mm×100 mm×25 mm (W×L×H). The filtration performance of this media was characterized using the Filtration Performance test as described above, the results of which are reported in Table 5.

Comparative Example C5

Comparative Example C5 was a commercially available pleated charged filter media based on a 30 g/m$^2$ basis weight non-woven electret split fiber web. The pleat height and spacing were 25 mm and 12.5 mm respectively, providing a total filter area of approximately 400 cm$^2$ for the tested filter that measured 100 mm×100 mm×25 mm (W×L×H). The filtration performance of this media was characterized using the Filtration Performance test as described above, the results of which are reported in Table 5.

Comparative Example C6

Polypropylene resin, type 2.8 MFI from ATOFINA Petrochemicals was formed into a microstructured structured film using standard extrusion techniques by extruding the resin onto a casting roll with a micro-grooved surface. The resulting cast film had a first smooth major surface and a second structured major surface with longitudinally arranged continuous microstructured features from the casting roll. The microstructured features on the film consisted of evenly spaced first primary structures and interlaced secondary structures. The primary structures were spaced 182 μm apart and had a substantially rectangular cross-section that was 76 μm tall and 55 μm wide (a height/width ratio of about 1.4) at the base with a sidewall draft of 5°. Three secondary structures having substantially rectangular cross-sections that were 25 μm tall and 26 μm wide at the base (height/width ratio of about 1) with a sidewall draft of 22° were evenly spaced between the primary structures at 26 μm intervals. The base film layer from which the microstructured features extended was 50 μm thick.

A first layer of structured film was corrugated into a contoured shape and attached, at its arcuate peaks, to a second structured film to form a flow channel laminate layer mm high with an arcuate peak. Overall height of the channel assembly, including cap layer was 2.4 mm.

The channel layer assembly was corona charged using standard corona charging techniques to a nominal surface voltage of 3 kV with the corrugated side having positive polarity and the flat side negative polarity.assembly. The method generally comprises forming the first structured film into a contoured sheet, forming the film so that it has arcuate portions projecting in the same direction from spaced generally parallel anchor portions, and bonding the spaced, generally parallel anchor portions of the contoured film to a second structured film backing layer with the arcuate portions of the contoured film projecting from the backing layer. This method is performed by providing first and second heated corrugating members or rollers each having an axis and including a plurality of circumferentially spaced generally axially extending ridges around and defining its periphery, with the ridges having outer surfaces and defining spaces between the ridges adapted to receive portions of the ridges of the other corrugating member in meshing relationship. The first structured film is fed between the meshed ridges while the corrugating members are counter-rotated. The ridges forming the gear teeth of both corrugating members were 2.8 mm tall and had an 8.5° taper from their base converging to a 0.64 mm wide flat top surface. Spacing between the teeth was 0.5 mm. The outer diameter of the corrugating members, to the flat top surface of the gear teeth, was 228 mm. The corrugating members were arranged in a stacked configuration with the top roll heated to a temperature of 21° C. and the bottom roll maintained at a temperature of 65° C. Engagement force between the two rolls was 262 Newtons per lineal cm of tooth width. With the corrugating apparatus configured in this manner the structure film, when passed through the intermeshing teeth of the corrugating members at a roll speed of 21 RPM, was compressed into and retained between the gear teeth of the lower corrugation member. With the first film registered in the teeth of the lower corrugation member the second structured film was laid over the periphery of the roll and adhered together with strands of polypropylene, type 7C50 resin (available from Union Carbide Corp., Danbury, Conn.) extruded from a multi-orifice die to the layer retained in the teeth of the lower corrugation member. Adhesion was accomplished between the first and second film at the top surface of the teeth of the corrugation member by passing the layer of material between a smooth roller and the top of the gear teeth. The thus formed corrugated flow channels were 1.7 mm in height with a base width of 1.8 mm and spacing between corrugations of 0.77 mm. The corrugations had generally straight sidewall 0.7

The filtration performance of a 100 mm×100 mm×25 mm (W×L×H) of this media was characterized using the Filtration Performance test as described above, the results of which are reported in Table 5.

TABLE 5

Comparisons of Filter Performance

| Example | Penetration, % | Pressure Drop (mm $H_2O$) | Quality Factor |
|---|---|---|---|
| C4 | 56.6 | 3.3 | 0.17 |
| C5 | 24.5 | 1.8 | 0.78 |
| C6 | 0.78 | 2.9 | 1.67 |
| C7 | 6.28 | 2.8 | 0.99 |
| 3 | 0.03 | 1.35 | 6.01 |

An examination of the data presented in Table 5 clearly shows the superior filtration performance of the filter media constructions of the present invention as compared to other commercially available and experimentally prepared filtration media constructions. The filter media of Example 3 exhibited a lower particle penetration and pressure drop than the four comparative filter media, resulting in a Quality Factor greater than 3× that of the nearest comparative filter media and over 6× that of the remaining three filter media.

Channel Height Optimization

Examination of the data presented in Table 4 suggests that channel height has a direct impact on filtration efficiency, pressure drop, as well as the quality factor of the filter media construction. Table 6 extracts a portion of the data in Table 4, looking specifically at filtration performance as a function of the channel height.

TABLE 6

Effects of Channel Height

| Example | Channel width (μm) | Rib Height (μm) | Aspect Ratio (W/H) | Solidity (%) | Efficiency (%) | Pressure Drop (mm $H_2O$) | Quality Factor (%) |
|---|---|---|---|---|---|---|---|
| 3 | 3,810 | 1,016 | 3.8 | 18.3% | 99.97% | 1.35 | 6.01 |
| 7 | 7,620 | 1,524 | 5.0 | 12.2% | 99.83% | 0.8 | 7.97 |
| 11 | 8,128 | 2,032 | 4.0 | 10.5% | 81.40% | 0.5 | 3.36 |

The overall performance of the ionizer-assisted structured surface filtration media configurations of the present invention reached an optimum, as judged by the Quality Factor, at a channel height of about 1500 μm or 1.5 mm.

Channel Aspect Ratio (W/H) Optimization

Examination of the data in Table 4 suggests that filter performance of the ionizer-assisted PEF filters of the present invention is influenced by the channel aspect ratio. Table 7 extracts a portion of the data in Table 4, looking specifically at filtration performance as a function of the channel aspect ratio.

Comparative Example C7

A charged channel structure was prepared and tested substantially as described in Example C6 except that a matte-finish flat film was substituted for the microstructured film. The flat film was made using a matte-finish casting roll that produced a nominal film thickness of 60 μm.

The filtration performance of a 100 mm×100 mm×25 mm (W×L×H) of this media was characterized using the Filtration Performance test as described above, the results of which are reported in Table 5.

TABLE 7

Effect of Channel Aspect Ratio on Filtration Performance

| Example | Channel width (μm) | Rib Height (μm) | Aspect Ratio (W/H) | Solidity (%) | Efficiency (%) | Pressure Drop (mm $H_2O$) | Quality Factor (%) |
|---|---|---|---|---|---|---|---|
| C1 | 1,016 | 1,016 | 1.0 | 27.3% | 99.62% | 3.5 | 1.59 |
| 2 | 2,032 | 1,016 | 2.0 | 21.4% | 99.87% | 1.68 | 3.95 |
| 3 | 3,810 | 1,016 | 3.8 | 18.3% | 99.97% | 1.35 | 6.01 |

Analysis of the data presented in Table 7 indicates that increasing channel aspect ratio produces improved performance with higher efficiency, lower pressure drop and greater quality factor. The only limitation for a greater aspect ratio is the physical strength of channels. In preparation of examples, it was found that adjacent channel layers tended to collapse when the aspect ratio is greater than 4~6 depending on the channel height. Preferably the filter channel aspect ratio ranges between 1 to 4.

Channel Shape Optimization

Flow channel shape also appears to influence filer performance in the ionizer-assisted microstructured surface filter media filters of the present invention. Table 8 extracts a portion of the data in Table 4 and Table 5, looking specifically at filtration performance as a function of the channel shape.

TABLE 8

Effects of Flow Channel Shape

| Example | Shape | Channel width (μm) | Rib Height (μm) | Aspect Ratio (W/H) | Penetration (%) | Pressure Drop (mm $H_2O$) | Quality Factor (%) |
|---|---|---|---|---|---|---|---|
| C4 | Arch | 2,300 | 1,650 | 1.4 | 6.28% | 2.8 | 0.99 |
| 9 | Rectangle | 2,540 | 1,651 | 1.5 | 0.62% | 1 | 5.10 |

The data in Table 8 suggests that rectangular shaped flow channels are preferred over arch shaped flow channels. The filter of Example 9, with rectangular shaped flow channels provided superior filtration performance, with 10× lower penetration, about 3× lower pressure drop, and 5× better quality factor.

What is claimed is:

1. An electrostaticly charged filtration media comprising:

a plurality of polymeric structured polymeric film layers having a first and a second major surface, at least the first major surface of the structured film layers comprising a structured surface which structures on the structured surface form, at least in part, flow channels the top of which flow channels are formed by an adjacent coplanar film layer, the plurality of structured film layers configured as a stack, the stack having a first and second face with the flow channels formed by the structured surfaces defining a plurality of ordered inlets, the inlets opening through the first face of the stack, that are in fluid communication with ordered fluid pathways, each fluid pathway defined at least in part by at least one discrete flow channel such that fluid can flow substantially unimpeded from the inlet of the fluid pathway to an outlet, the outlet opening through the second face of the stack, wherein each layer of fluid pathways is defined by two opposing charged film layers, at least one of which is a structured film layer wherein the flow channels have an height of from 0.1 mm to 5 mm and an average width of from 0.05 mm to 50 mm and an average width to height aspect ratio of from 0.5 to 10.

2. The filtration media of claim 1 wherein the ordered fluid pathways are defined by the plurality of flow channels formed on the structured surfaces of the structured film layers.

3. The filtration media of claim 2, wherein the plurality of flow channels are defined by a series of peaks, each peak having two sidewalls separated by a floor.

4. The filtration media of claim 3, wherein the sidewalls of adjacent peaks of the flow channels are separated by a planar floor.

5. The filtration media of claim 3, wherein the sidewalls of adjacent peaks of the flow channels are separated by at least one sub-peak, the sub-peak defining a plurality of sub-structures on the floor.

6. The filtration media of claim 3, wherein the opposing charged film layers are passively electrostaticly charged.

7. The filtration media of claim 2, wherein the flow channels of a structured film layer each comprise a cross-sectional characteristic, the cross-section characteristic of at least a portion of the flow channels varying across the surface of the structured film layer.

8. The filtration media of claim 2, wherein one flow channel of a structured film layer is configured differently from another flow channel of the same structured film layer.

9. The filtration media of claim 8, wherein a flow channel of one structured film layer is configured differently from a flow channel of another structured film layer.

10. The filtration media of claim 2, wherein the flow channels of one structured film layer are offset relative to the flow channels of an adjacent structured film layer within the stack.

11. The filtration media of claim 1, wherein the opposing charged film layers are actively electrostaticly charged.

12. The filtration media of claim 11, wherein the charged film layers include a conductive metal layer connected to an electrical potential.

13. The filtration media of claim 11, wherein the conductive metal layer is a metalized layer on a flat face of a polymeric film layer.

14. The filtration media of claim 1, wherein at least a portion of the plurality of structured film layers are bonded together.

15. The filtration media of claim 1, further comprising an opposing cap layer covering at least a portion of one of the plurality of structured film layers.

16. The filtration media of claim 15, wherein the cap layer comprises the top most layer of the stack of structured film layers.

17. The filtration media of claim 1, further comprising at least one additional layer located between two adjacent structured film layers for the purpose of enhancing filtration performance.

18. The filtration media of claim 17, wherein at least two adjacent structured film layers structured faces face one another with the additional layer in between the structured faces.

19. The filtration media of claim 1, wherein every structured film layer of the stack is formed from the same polymeric material.

20. The filtration media of claim 1, wherein at least a portion of the plurality of structured film layers are formed from polytetrafluoroethylene.

21. The filtration media of claim 1, wherein at least a portion of the plurality of structured film layers are formed from polypropylene.

22. The filtration media of claim 1, wherein at least a portion of the surfaces of the plurality of structured film layers are treated for the purpose of enhancing filtration performance.

23. The filtration media of claim 2, wherein the filtration surfaces of the structured film layers comprise material for providing at least one of the filtration benefits of enhanced particle removal, oil and water repellency, odor removal, organic matter removal, ozone removal, disinfection, drying, and fragrance introduction.

24. The electrofiltration media of claim 1 wherein the structured film layers are stretch oriented in the direction of the flow channels.

25. An electrofiltration apparatus comprising an ionization stage and a particle collection stage, the particle collection stage comprising a statically charged filtration media comprising a plurality of polymeric structured polymeric film layers having a first and a second major surface, at least the first major surface of the structured film layers comprising a structured surface which structures on the structured surface form, at least in part, flow channels, the top of which flow channels are formed by an adjacent coplanar film layer, the plurality of structured film layers configured as a stack, the stack having a first and second face with the flow channels formed by the structured surfaces defining a plurality of ordered inlets, the inlets opening through the first face of the stack, that are in fluid communication with ordered fluid pathways, each fluid pathway defined at least in part by at least one discrete flow channel such that fluid can flow substantially unimpeded from the inlet of the fluid pathway to an outlet, the outlet opening through the second face of the stack, wherein each layer of fluid pathways is defined by two opposing charged film layers, at least one of which is a structured film layer wherein the flow channels have a height of from 0.1 mm to 5 mm and an average width of from 0.05 mm to 50 mm and an average width to height aspect ratio of from 0.5 to 10.

26. The electrofiltration apparatus of claim 25 wherein the ordered fluid pathways are defined by the plurality of flow channels formed on the structured surfaces of the structured film layers.

27. The electrofiltration apparatus of claim 26, wherein the plurality of flow channels are defined by a series of peaks, each peak having two sidewalls separated by a floor.

28. The electrofiltration apparatus of claim 27, wherein the sidewalls of adjacent peaks of the flow channels are separated by a planar floor.

29. The electrofiltration apparatus of claim 27, wherein the sidewalls of adjacent peaks of the flow channels are separated by at least one sub-peak, the sub-peak defining a plurality of sub-structures on the floor.

30. The electrofiltration apparatus of claim 27 wherein the opposing charged film layers are passively electrostaticly charged.

31. The electrofiltration apparatus of claim 27, wherein the flow channels of a structured film layer each comprise a cross-sectional characteristic, the cross-section characteristic of at least a portion of the flow channels varying across the surface of the structured film layer.

32. The electrofiltration apparatus of claim 26, wherein one flow channel of a structured film layer is configured differently from another flow channel of the same structured film layer.

33. The electrofiltration apparatus of claim 32, wherein a flow channel of one structured film layer is configured differently from a flow channel of another structured film layer.

34. The electrofiltration apparatus of claim 26, wherein the flow channels of one structured film layer are offset relative to the flow channels of an adjacent structured film layer within the stack.

35. The electrofiltration apparatus of claim 25, wherein the opposing charged film layers are actively electrostaticly charged.

36. The electrofiltration apparatus of claim 35, wherein the charged film layers include a conductive metal layer connected to an electrical potential.

37. The electrofiltration apparatus of claim 35, wherein the conductive metal layer is a metalized layer on a flat face of a polymeric film layer.

38. The electrofiltration apparatus of claim 25, wherein at least a portion of the plurality of structured film layers are bonded together.

39. The electrofiltration apparatus of claim 25, further comprising an opposing cap layer covering at least a portion of one of the plurality of structured film layers.

40. The electrofiltration apparatus of claim 39, wherein the cap layer comprises the top most layer of the stack of structured film layers.

41. The electrofiltration apparatus of claim 25, further comprising at least one additional layer located between two adjacent structured film layers for the purpose of enhancing filtration performance.

42. The electrofiltration apparatus of claim 41, wherein at least two adjacent structured film layers structured faces face one another with the additional layer in between the structured faces.

43. The electrofiltration apparatus of claim 25, wherein every structured film layer of the stack is formed from the same polymeric material.

44. The electrofiltration apparatus of claim 25, wherein at least a portion of the plurality of structured film layers are formed from polytetrafluoroethylene.

45. The electrofiltration apparatus of claim 25, wherein at least a portion of the plurality of structured film layers are formed from polypropylene.

46. The electrofiltration apparatus of claim 25, wherein at least a portion of the surfaces of the plurality of structured film layers are treated for the purpose of enhancing filtration performance.

47. The electrofiltration apparatus of claim 26, wherein the filtration surfaces of the structured film layers comprise material for providing at least one of the filtration benefits of enhanced particle removal, oil and water repellency, odor removal, organic matter removal, ozone removal, disinfection, drying, and fragrance introduction.

48. The electrofiltration apparatus of claim 25 wherein the structured film layers are stretch oriented in the direction of the flow channels.

* * * * *